US005401188A

United States Patent [19]

Kosmala

[11] Patent Number: 5,401,188

[45] Date of Patent: Mar. 28, 1995

[54] BOARDLOCK CLIP

[75] Inventor: Michael L. Kosmala, Aliso Viejo, Calif.

[73] Assignee: ITT Corporation, Secaucus, N.J.

[21] Appl. No.: 134,784

[22] Filed: Oct. 12, 1993

[51] Int. Cl.[6] ..... H01R 13/73

[52] U.S. Cl. ..... 439/567

[58] Field of Search ..... 439/567, 571, 554, 82, 439/876, 751

[56] References Cited

U.S. PATENT DOCUMENTS

| | | | |
|---|---|---|---|
| 2,138,404 | 11/1938 | Haas | 29/148 |
| 2,646,613 | 7/1953 | Enzler | 29/155.55 |
| 3,286,671 | 11/1966 | Fuller | 113/119 |
| 3,538,491 | 11/1970 | Longenecker et al. | 439/851 |
| 3,634,879 | 1/1972 | Longenecker et al. | 439/525 |
| 3,699,637 | 10/1972 | Rosiek | 29/432.1 |
| 3,963,319 | 6/1976 | Schumacher et al. | 439/439 |
| 4,380,116 | 4/1983 | Gossler et al. | 29/611 |
| 4,639,066 | 1/1987 | Shimamiya et al. | 439/569 |
| 4,679,883 | 7/1987 | Assini et al. | 439/607 |
| 4,721,473 | 1/1988 | DelGuidice et al. | 439/79 |
| 4,769,896 | 9/1988 | Denlinger et al. | 29/509 |
| 4,842,552 | 6/1989 | Frantz | 439/557 |
| 4,865,555 | 9/1989 | Assini et al. | 439/82 |
| 5,046,243 | 9/1991 | Walker | 29/878 |
| 5,066,237 | 11/1991 | Shiley | 439/82 |
| 5,115,375 | 5/1992 | Garay | 361/400 |
| 5,295,862 | 3/1994 | Mosquera | 439/567 |

FOREIGN PATENT DOCUMENTS 3939746 12/1989 Germany .

*Primary Examiner*—Gary F. Paumen
*Attorney, Agent, or Firm*—Thomas L. Peterson

[57] ABSTRACT

A boardlock clip is described, for holding a connector (12, FIG. 3) to a circuit board (14) and for electrically grounding them to each other, which is strong and which assures a reliable solder connection between the clip and a board plating. The clip has a mount (30) for mounting on a connector and a boardlock (32) for insertion into a cylindrical circuit board hole (26), the boardlock including three downwardly extending beams (41–43) with lower portions (52) that engage the bottom (56) of the hole walls. Each beam lower portion has a flat middle part (62) and has a pair of edge parts (64, 66) that are bent partially radially outwardly so the edge parts directly engage the bottom of the hole walls, for increased strength and to provide distinct solder locations. The upper portion of each beam has edge parts (92, 94) which are bent radially inwardly to avoid contacting the hole walls while stiffening the beam upper portion against bending.

8 Claims, 3 Drawing Sheets

FIG. 1
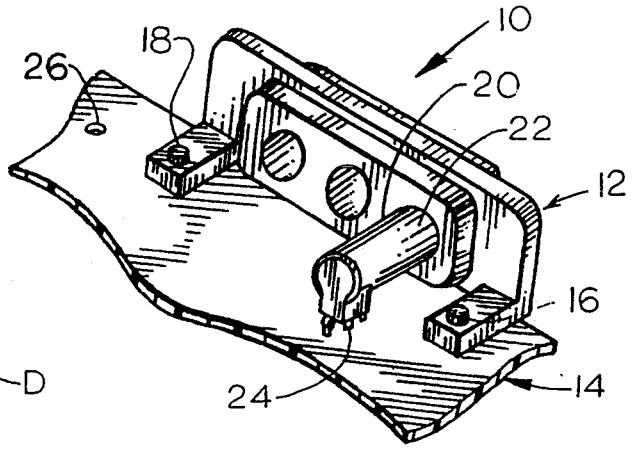
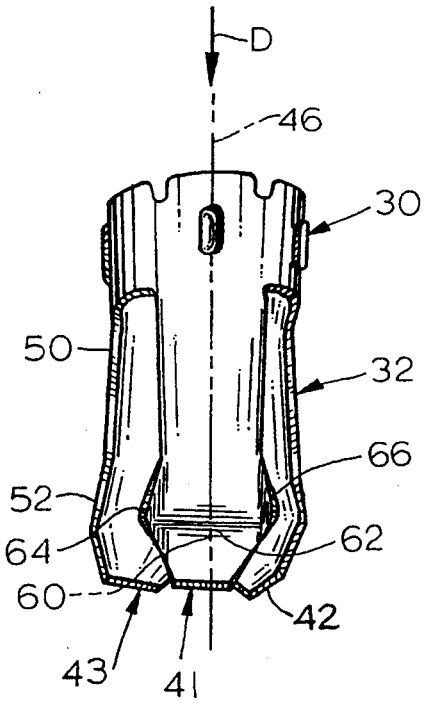
FIG. 2
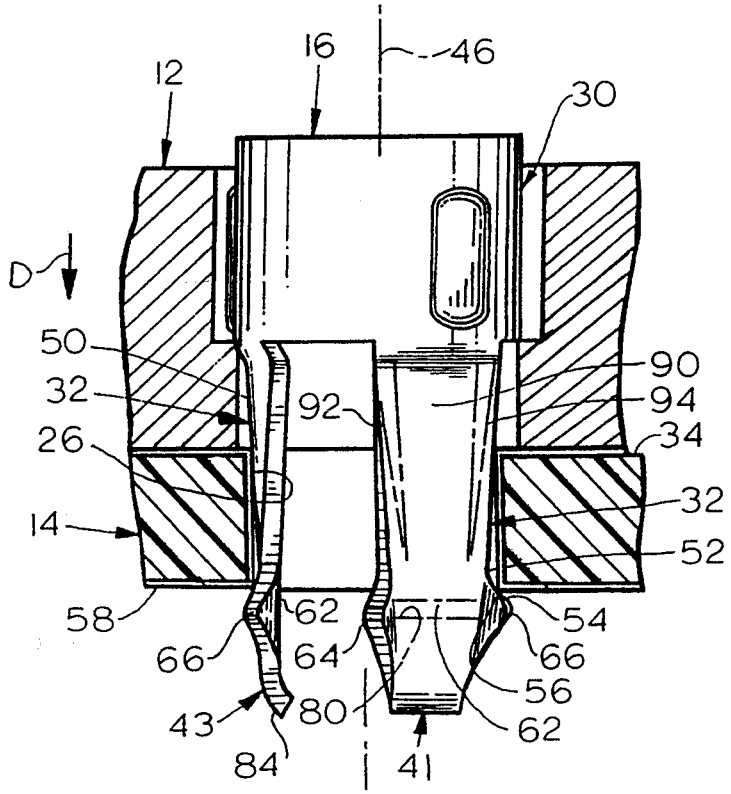
FIG. 3

BOARDLOCK CLIP

BACKGROUND OF THE INVENTION

It is common practice to mount a connector to a circuit board by boardlock clips that extend into holes drilled into the circuit board. U.S. Pat. No. 4,865,555 shows an example of such a clip, which has beams with lower portions extending at an outward incline to press against the lower ends of the board holes, the clips being soldered into place. A boardlock clip of this type, wherein the beams were strengthened and rigidized against bending for higher holding force, and wherein the solder connections were more predictable, would be of value.

SUMMARY OF THE INVENTION

In accordance with one embodiment of the present invention, a boardlock clip is provided for mounting a connector on a circuit board, wherein the clip has high strength and provides for predictable soldering to a plated circuit board hole. The clip has a plurality of downwardly extending beams the clip may also have 4 or more beams if desired that lie in the circuit board hole and which include lower beam portions that engage the lower ends of the board hole. Each lower beam portion has a middle part and opposite edge parts, with each edge part being bent radially outwardly to engage the bottom of the board holes while the middle part is spaced from the board hole. The bent edge parts lie on a section of the beam lower portion which is of greatest width, with the beam lower portion being tapered to be narrower both above and below the section of greatest width. Each upper beam portion has a middle part and has opposite edge parts that are bent at least partially radially inwardly from the middle part to strengthen and stiffen the upper beam portion.

When the boardlock clip is fully inserted into the connector and circuit board to hold them together, the clip is usually soldered in place to the plated hole of the circuit board. The shape of each lower beam portion results in a reliable solder connection between the bent edge part of each beam lower portion and the plated hole walls.

The novel features of the invention are set forth with particularity in the appended claims. The invention will be best understood from the following description when read in conjunction with the accompanying drawings.

BRIEF DESCRIPTION OF THE DRAWINGS

FIG. 1 is a partial isometric view of a combination of a connector and circuit board held together by boardlock clips, constructed in accordance with the present invention.

FIG. 2 is a bottom and side isometric view of a boardlock clip of the combination of FIG. 1.

FIG. 3 is a sectional side view of a portion of the combination of FIG. 1, prior to soldering the clip in place.

DESCRIPTION OF THE PREFERRED EMBODIMENTS

Figure 4:
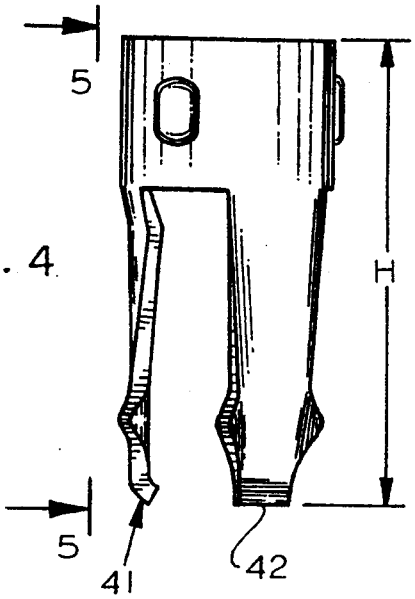
FIG. 4 is a side elevation view of the clip of FIG. 3, shown from its opposite side.

FIG. 1 illustrates a combination 10 of a connector 12, circuit board 14, and boardlock clips 16, 18 that hold the connector to the circuit board. The particular connector 12 shown is one which is designed to hold coaxial contact assemblies 20, wherein each contact assembly includes a grounded outer conductor 22 and an inner conductor 24 which engages a trace (not shown) on the circuit board. The circuit board has holes 26, and each boardlock clip extends through corresponding holes in the connector and circuit board to hold them together. Each of the board holes 26 is usually plated with a metal that is connected to a ground plane on the circuit board, and the board clips are usually soldered in place.

FIG. 3 shows one of the boardlock clips 16, which includes a mount region or mount 30 that is mounted on the connector 12 and a boardlock region or boardlock 32 that extends through the circuit board hole 26 to hold the connector substantially against an upper surface 34 of the circuit board. As also shown in FIG. 2, the boardlock 32 of the clip includes three retention beams 41–43 that each extends primarily downwardly, in the direction D parallel to the vertical axis 46 of the clip, from the mount 30. The clip may also have four or more beams if desired. Each beam has upper and lower beam portions 50, 52, with the lower portion and end 82 being free (unsupported). As shown in FIG. 3, each beam lower portion has a radially outwardly-downwardly angled surface 54, which engages the lower end or edge 56 of the hole walls, where they merge or intersect with the lower surface 58 of the circuit board. The three beams 41–43 are of substantially identical shape, and each beam is symmetrical about an imaginary vertical center line 60.

Figure 5:
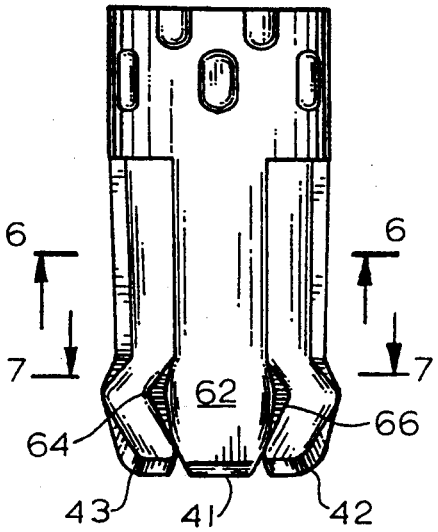
FIG. 5 is a view taken on the line 5—5 of FIG. 4.
Figure 7:
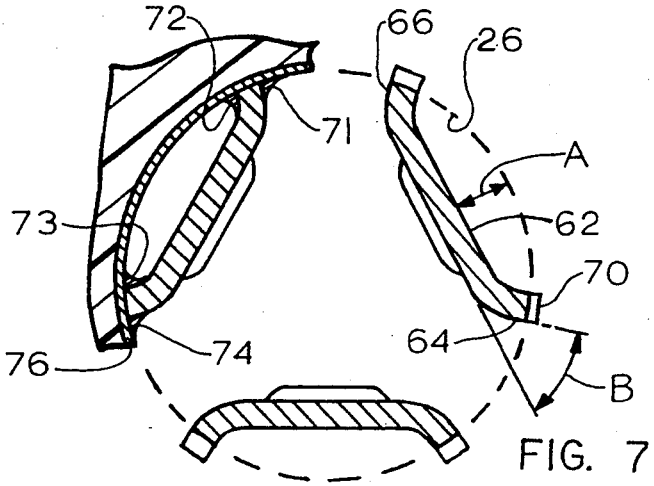
FIG. 7 is a partial sectional view taken on the line 7—7 of FIG. 5, and showing a portion of the circuit board hole.

Each beam lower portion 52 has a middle part 62 and has a pair of edge parts 64, 66, the edge parts lying on opposite sides of the middle part. Each edge part 64, 66 is bent at least partially radially (with respect to axis 46) outwardly to extend further from the axis 46 than the middle part 62. As a result, the edge parts 64, 66 engage the lower hole wall ends at 56, while the middle part 62 is spaced from the lower hole wall ends. FIG. 7, which is taken on the line 7—7 of FIG. 5, shows that the middle part 62 is preferably flat and lies a substantial distance A from the walls of the circuit board hole 26. Each of the edge parts 64, 66 is preferably joined to the middle part 62 at a bend angle B of more than 10° so the extreme edges 70 extend largely parallel to the adjacent location on the walls of the board hole 26.

An important advantage of the lower beam portion construction shown in FIG. 7, with the bent edge portion 64, 66, is that this strengthens and stiffens the beam at the location where it engages the bottom of the hole wall. In addition, the bent edge portions provide for predictable soldering of the beam lower portions to the plated hole walls, as described below.

After the clips are installed, they are usually soldered in place. The quantity of solder for each beam includes four solder fillets 71–74 joining the two edge parts 64, 66 to the plating walls 76 of the board hole 26. The provision of four somewhat separate solder fillets results in predictable soldering, and with redundancy assuring that there will be a good solder connection even if one or two fillets are damaged. In prior clips, the lower beam portions which engage the lower ends of the hole walls were often flat or curved to follow the hole, which resulted in a substantially single solder connection for each beam. If a single solder connection failed, then the connector was not as reliably held down to the circuit board.

Referring again to FIG. 3, it can be seen that horizontal section 80 of each beam lower portion has a maximum width, and that the lower portion is tapered to be narrower both above and below the section 80 of greatest width. The edge parts 64, 66 are located at the section 80 of greatest width, which facilitates bending of the edge parts radially outwardly without the need for a slit to separate the bent part from the rest of the beam. Any such slit would weaken the beam lower portion. The bending is gradual rather than sharp, which results in a concavely curved outwardly-downwardly angled beam surface portion at 54 which engages the bottom of the hole walls. The extreme bottom part 84 of each beam is bent radially inwardly toward the axis 46, which facilitates initial insertion of the clip into the circuit board.

Figure 6:
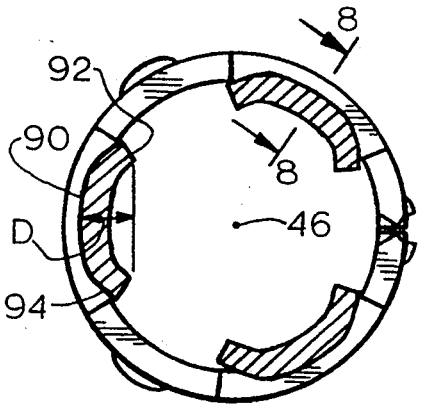
FIG. 6 is a sectional view taken on the line 6—6 of FIG. 5.

The upper portion 50 of each beam has a cross section such as shown in FIG. 6, which includes a middle part 90 and opposite edge parts 92, 94. Each edge part is bent radially inwardly, partially towards the axis 46 of the clip. The bending results in the thickness D of the beam being greater than the thickness that would be obtained if the same piece of sheet metal forming the beam were bent into a section of a circle formed by the board hole. The radially inwardly bent edge portions 92, 94 strengthen and stiffen the upper beam portions, to provide greater holding power.

Figure 8:
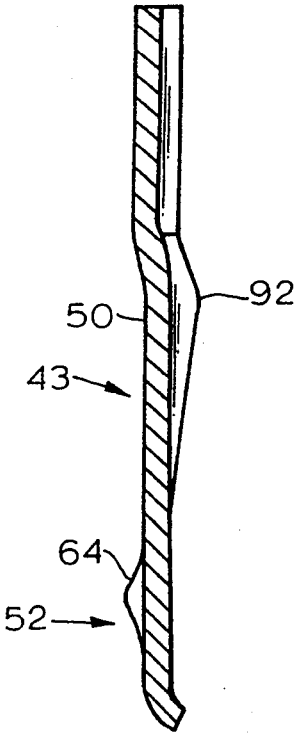
FIG. 8 is a sectional view taken on the line 8—8 of FIG. 6.

FIG. 8 shows the general construction of a beam 43, showing that the upper beam portion 50 is of increased thickness due to the radially inwardly bent edge parts such as 92, while the lower beam portion 52 is strengthened by the radially outwardly bent edge parts such as 64. The reason for bending the side parts of the upper beam portion radially inwardly, is to keep them out of firm contact with the hole walls, so that the greatest contact pressure occurs at the radially outwardly bent edge parts such as 64 of the lower beam portion.

Figure 9:
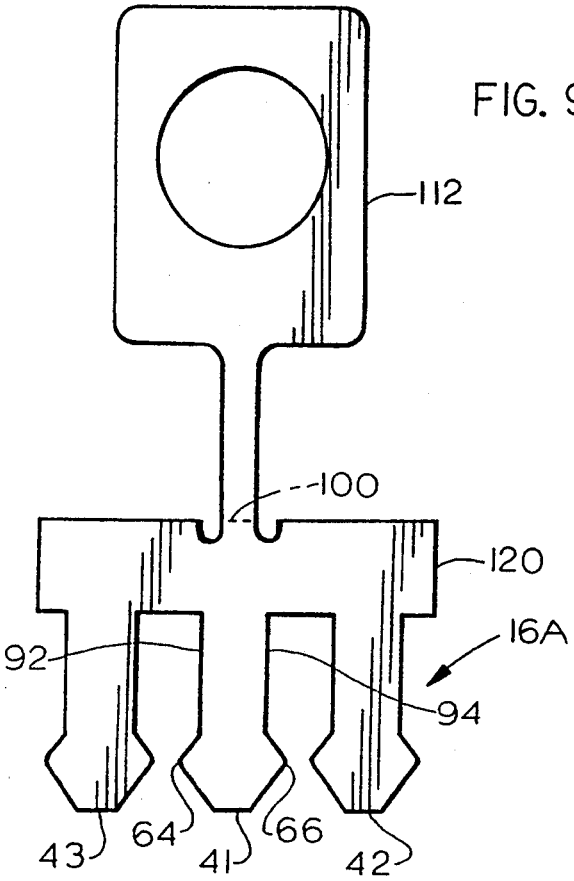
FIG. 9 is a plan view of the clip of FIG. 2, shown after blanking but before bending, and also showing attached thereto a grounding tag which is used in another embodiment of the invention.
Figure 11:
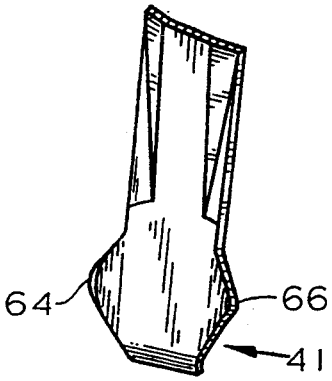
FIG. 11 is a partial isometric view showing one of the beams of the clip of FIG. 3.
Figure 10:
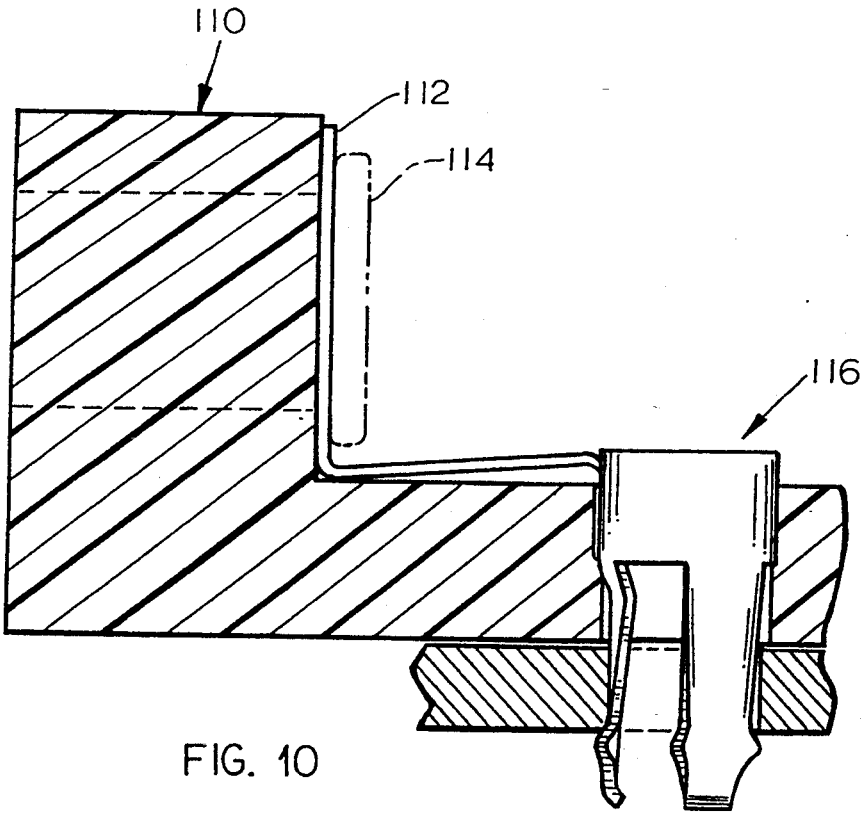
FIG. 10 is a partial sectional view of a combination connector and circuit board held together by a boardlock clip of another embodiment of the invention which includes the grounding tag of FIG. 9.

The boardlock clip is formed from sheet metal which has been blanked to the shape shown at 16A in FIG. 9. For use with a connector housing of metal, the clip would be cut off at the location 100. For a connector such as shown in FIG. 10 at 110, wherein the connector has a plastic body, the clip would be provided with a grounding tag 112 which is held in place by a rivet 114 to assure that the clip is grounded to a grounded plating of the connector. Otherwise, the clip 116 of FIG. 10 is identical to the clip of FIGS. 1–8.

As shown in FIG. 9, the clip at 16A has been blanked from a piece of sheet metal, to form the three beams 41–43 and a band 120 that will form the mount of the clip. After the clip has been formed as in FIG. 9, the edge parts 64, 66 of the lower beam portions are bent in one direction and the edge parts 92, 94 of the upper beam portions are bent in the opposite direction. Then, the sheet metal is bent into a circle to the configuration shown in FIGS. 1–8. Only the band 120 and the upper ends of the beams have to be bent in a circle.

While terms such as "upper", "lower", "horizontal", and the like have been used to aid in the description of the invention as illustrated in the drawings, it should be understood that the boardlock clip and other parts can be used in any orientation with respect to gravity.

In one boardlock clip that applicant has constructed, the clip was formed of 0.010 thick metal and had an overall height H (FIG. 4) of 0.259 inch for insertion in a board hole of a diameter of 0.125 inch. The other dimensions are proportionately shown in the drawings.

Thus, the invention provides a boardlock clip and a combination wherein the clip holds a connector to a circuit board, wherein the strength and rigidity of the clip beams are increased and the soldering of the beams to the lower edges of the circuit board holes is made more consistent than heretofore. Each of the retention beams of the clip has a lower portion with opposite edge parts that are bent radially outwardly to engage the bottom of the board hole, the lower portion of the beam having a widest section at the outwardly-bent side parts and being tapered in width above and below that section. The upper beam portion also has largely radially bent side parts, but they are bent radially inwardly rather than outwardly. The installed clip is soldered in place, with solder fillets joining opposite surfaces of each radially outwardly bent edge part of the lower beam portion to the plated walls of the hole. Although three are shown, the clip may have four or more beams.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A boardlock clip having a mount for mounting on a connector and having a boardlock for insertion into a circuit board hole to hold the connector substantially against the board, wherein the board hole has lower wall ends that intersect the lower surface of the board, and wherein the clip has a vertical axis and a plurality of retention beams extending generally downwardly from the mount, each beam having a lower beam portion with a radially outwardly-downwardly angled surface positioned to engage the lower hole wall ends, characterized by:

each of said lower beam portions has a middle part and has a pair of edge parts on opposite sides of said middle part, said edge parts each being bent at least partially radially outwardly to extend radially further from said axis than said middle part, so said edge parts can engage said lower hole wall ends while said middle part is spaced from said lower hole wall ends.

2. The boardlock clip described in claim 1 wherein:

said beam lower portions each have a horizontal section of greatest width and each is tapered to be narrower both above and below said section of greatest width, and said edge parts are bent radially outwardly beyond said middle part at said section of greatest width.

3. The boardlock clip described in claim 1 wherein:

each of said beam lower portions is flat except at said edge parts.

4. The boardlock clip described in claim 1 including said connector and said circuit board, and wherein:

said clip mount is mounted on said connector and said boardlock projects through said board hole, said hole walls having a metal plating; and including a quantity of solder that bonds said clip to said board hole, including a plurality of solder fillets each directly bonding one side of each edge part to said metal plating.

5. The boardlock clip described in claim 1 wherein:

each of said beam upper portions has a pair of largely vertically extending opposite side regions that are bent radially inwardly.

6. A combination of a circuit board having a plurality of cylindrical holes extending between its upper and lower surfaces with each hole having a plating, a connector mounted on said board upper surface, and a plurality of boardlock clips each having a vertical axis and a mount mounted on said connector and a plurality of beams projecting down from said mount and through a corresponding one of said holes, wherein:

each of said beams has a lower portion extending through the level of the board lower surface, with said beam lower portions having substantially flat parts and having angled board-engaging parts extending at least partially radially outwardly from said flat parts and pressing against the intersection of said board lower surface and said hole walls; and including a quantity of solder that includes a plurality of solder fillets each directly bonding one side of each of said angled board-engaging parts to said hole plating.

7. A method for holding a connector to a circuit board that has walls forming plated cylindrical holes, which includes forming a piece of sheet metal into a clip with a vertical axis, with an upper portion in the form of a band and with a lower portion in the form of a plurality of vertical beams having upper ends joined to said upper portion and having free lower ends and having opposite side edge portions, and which also includes installing said clip upper portion in said connector and inserting said clip lower portion downwardly through one of said board holes to an inserted position characterized by:

forming a lower part of each beam, in a region which lies at the bottom of the board hole in the inserted position, so the lower part is tapered to be widest at a position spaced below the bottom of the circuit board and to be narrower at locations both above and below said widest position, and bending the opposite side edge portions of said lower part at said position, to form a pair of tabs each extending with a radially outward directional component;

said step of inserting includes inserting said clip until the edges of said tabs bear against the bottom of the walls of the corresponding holes.

8. The method described in claim 7 wherein:

soldering said clip to said plated hole walls, including forming a solder fillet between said wall and each side of each tab.

* * * * *